US005357081A

United States Patent [19]

Bohorquez

[11] Patent Number: 5,357,081

[45] Date of Patent: Oct. 18, 1994

[54] POWER SUPPLY FOR INDIVIDUAL CONTROL OF POWER DELIVERED TO INTEGRATED DRIVE THERMAL INKJET PRINTHEAD HEATER RESISTORS

[75] Inventor: Jaime H. Bohorquez, Escondido, Calif.

[73] Assignee: Hewlett-Packard Company, Palo Alto, Calif.

[21] Appl. No.: 7,221

[22] Filed: Jan. 21, 1993

[51] Int. Cl.[5] ..... H05B 1/02

[52] U.S. Cl. ..... 219/497; 219/501; 219/508; 219/216; 307/38

[58] Field of Search ..... 219/209, 210, 216, 494, 219/497, 501, 508, 483, 486; 307/38–41, 117

[56] References Cited

U.S. PATENT DOCUMENTS

| | | | |
|---|---|---|---|
| 3,308,271 | 3/1967 | Hilbiber | 219/210 |
| 3,710,913 | 1/1973 | Brennan, Jr. et al. | 346/76 |
| 4,459,469 | 7/1984 | Ishima | 219/497 |
| 4,599,523 | 7/1986 | Pless et al. | 307/41 |
| 4,662,736 | 5/1987 | Taniguchi et al. | 354/412 |
| 4,791,311 | 12/1988 | Vig | 307/38 |
| 5,223,853 | 6/1993 | Wysocki et al. | 346/1.1 |

*Primary Examiner*—Mark H. Paschall

[57] ABSTRACT

A circuit for controlling the power applied to the heater resistor of a thermal inkjet printer printhead wherein the heater resistor is connected to a first source of current. The inventive circuit includes a first transistor having a first terminal connected to the heater resistor, a second terminal connected to a return path for the heater resistor and a simple circuit for maintaining a constant voltage at a third terminal of the transistor. In a particular embodiment, the circuit for maintaining a constant voltage at the third terminal of the transistor includes a diode connected between the second and third terminals and a resistor connected between a second source of current and the third terminal of the transistor. In the illustrative embodiment, the transistor is a bipolar NPN transistor and the anode of the diode is connected to the base terminal thereof. In the best mode, the diode is fabricated by connecting the base and collector terminals of a second transistor fabricated on a substrate with the first transistor. The invention provides a simple, low cost, reliable system for controlling the power applied to the heater resistor of a thermal inkjet printhead which consumes little power.

13 Claims, 3 Drawing Sheets

POWER SUPPLY FOR INDIVIDUAL CONTROL OF POWER DELIVERED TO INTEGRATED DRIVE THERMAL INKJET PRINTHEAD HEATER RESISTORS

BACKGROUND OF THE INVENTION

1. Field of the Invention

The present invention relates to thermal inkjet printer technology. More specifically, the present invention relates to systems and techniques for energizing heater resistors within an inkjet printhead to expel ink.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

Thermal inkjet printers are currently used for a wide variety of high speed, high quality printing applications. These printers include a thermal inkjet printhead. The thermal inkjet printhead includes one or more ink-filled channels communicating with an ink supply chamber or cartridge at one end and having an opening at the opposite end, referred to as a nozzle. A heater resistor is located in the channel at a predetermined distance underneath the nozzle. The resistors are individually addressed with a current pulse to momentarily vaporize the ink to form a bubble. The bubble expels an ink droplet towards a recording medium such as paper. By energizing heater resistors in different combinations as the printhead moves across the paper, an inkjet printer prints different characters on the paper.

The heater resistors within the printhead are addressed through flexible conductors that connect the resistors to control circuitry within the thermal inkjet printer. In many prior systems, each resistor was connected directly to a flexible conductor. However, inasmuch as resolution of the printed characters is improved by adding nozzles, the drive for greater print quality has created an associated increase in the number of heater resistors in a printhead. This caused an associated increase in the number of conductors required to address the individual heater resistors. To minimize the number of conductors required, many resistors were connected to a common return line. Thus, the conventional printhead had one conductor per resistor and a common return.

With as many as 10–13 resistors per common return, the cumulative current in the return was, in many cases, so high as to cause a significant voltage drop and associated power dissipation in the return line. This lowered the voltage and power delivered to the heater resistor. Hence, because of the resistance of the power and return conductors of a thermal inkjet printhead, the power delivered to the individual elements was a function of the number of the elements energized. Since, optimum print quality requires precise control of the energy supplied to the heater resistor, losses in the return line were adversely affecting the operation of the system.

This effect was minimized by energizing only one element per power/return pair. In these systems, external power transistors were activated in sequence to provide drive current to the heater resistors to be fired during a print cycle.

However, the provision of a separate transistor per resistor was expensive. In addition, this technique required a large number of external connections to the printhead and a considerable amount of power was lost in the control element used to sequence the transistors.

The interconnect problem was mitigated somewhat by numerous decoding schemes. One such scheme is that of U.S. Pat. No. 3,852,563, entitled THERMAL PRINTING HEAD, issued Dec. 3, 1974 to J. H. Bohorquez, the teachings of which are incorporated herein by reference.

A more sophisticated multiplexing scheme was developed by which logic circuitry comprising active elements (transistors) were added to the printhead.

In any event, the loss elements were the trace (the conductor from the resistor to the contact to the external circuitry), the heating element, and the return are all loss elements. Nonetheless, a problem remained in delivering a correct voltage to the heating element notwithstanding changes in the circuitry surrounding the element.

U.S. Pat. No. 5,083,137 entitled ENERGY CONTROL CIRCUIT FOR A THERMAL INK-JET PRINTHEAD, issued Jan. 21, 1992 to Badyal et al. (the teachings of which are also incorporated herein by reference) discloses a system for addressing the problem by controlling the power to each heating element individually. A measurement resistor is added and used to measure the current through the heater resistor. By regulating the power delivered to the element, the energy may be delivered to the element independent of the losses in the power and return lines.

However, this method has several disadvantages, First, a considerable amount of additional circuitry is required in order to control the current through each heater resistor. This is costly in manufacturing time and space on the substrate. In addition, the measurement resistor and the other control elements are lossy.

Thus, a need remains in the art for a more efficient, less expensive technique for individually controlling the power applied to a heater resistor in the printhead of an inkjet printer.

SUMMARY OF THE INVENTION

The need in the art is addressed by the present invention which provides a circuit for controlling the power applied to the heater resistor of a thermal inkjet printer printhead wherein the heater resistor is connected to a first source of current. The inventive circuit includes a first transistor having a first terminal connected to the heater resistor, a second terminal connected to a return path for the heater resistor and a simple circuit for maintaining a constant voltage at a control terminal of the transistor. In a particular embodiment, the circuit for maintaining a constant voltage at the control terminal of the transistor includes a diode connected between the second and control terminals and a resistor connected between a second source of current and the control terminal of the transistor. In the illustrative embodiment, the transistor is a bipolar NPN transistor and the anode of the diode is connected to the base terminal thereof. In the best mode, the diode is fabricated by connecting the base and collector terminals of a second transistor fabricated on a substrate with the first transistor. This mode provides best matching of operational parameters of the diode and the transistor.

The inventive circuit provides a simple, low cost, reliable system for controlling the power applied to the heater resistor of a thermal inkjet printhead which consumes little power.

DESCRIPTION OF THE INVENTION

Illustrative embodiments and exemplary applications will now be described with reference to the accompanying drawings to disclose the advantageous teachings of the present invention.

Figure 1:
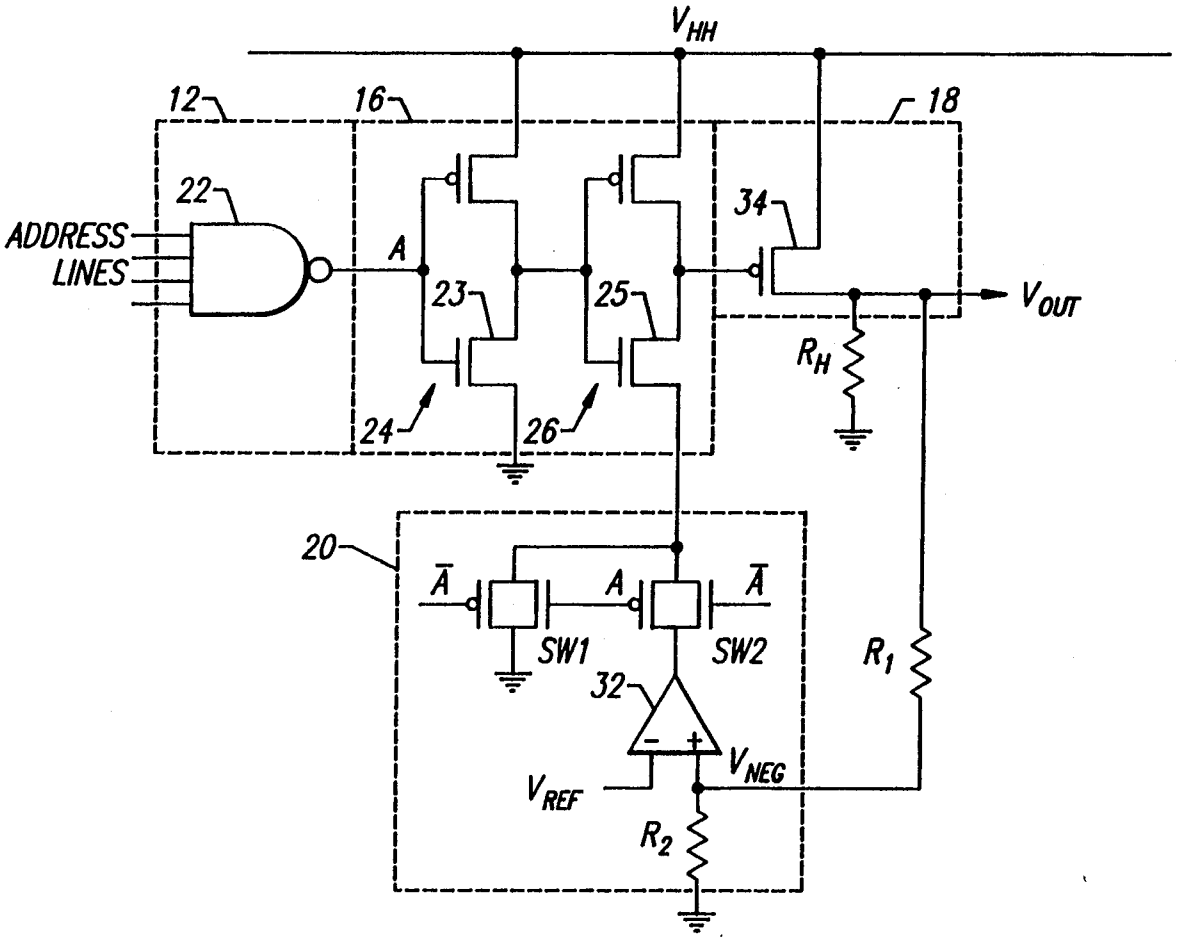
FIG. 1 is a schematic diagram of a conventional energy control circuit for the heater resistor of a thermal inkjet printhead implemented in metal-oxide semiconductor (MOS) technology.

The novel and advantageous design of the present invention is best illustrated with a review of typical conventional designs. FIG. 1 is a schematic diagram of a conventional energy control circuit for the heater resistor of a thermal inkjet printhead implemented in metal-oxide semiconductor technology.

Figure 2:
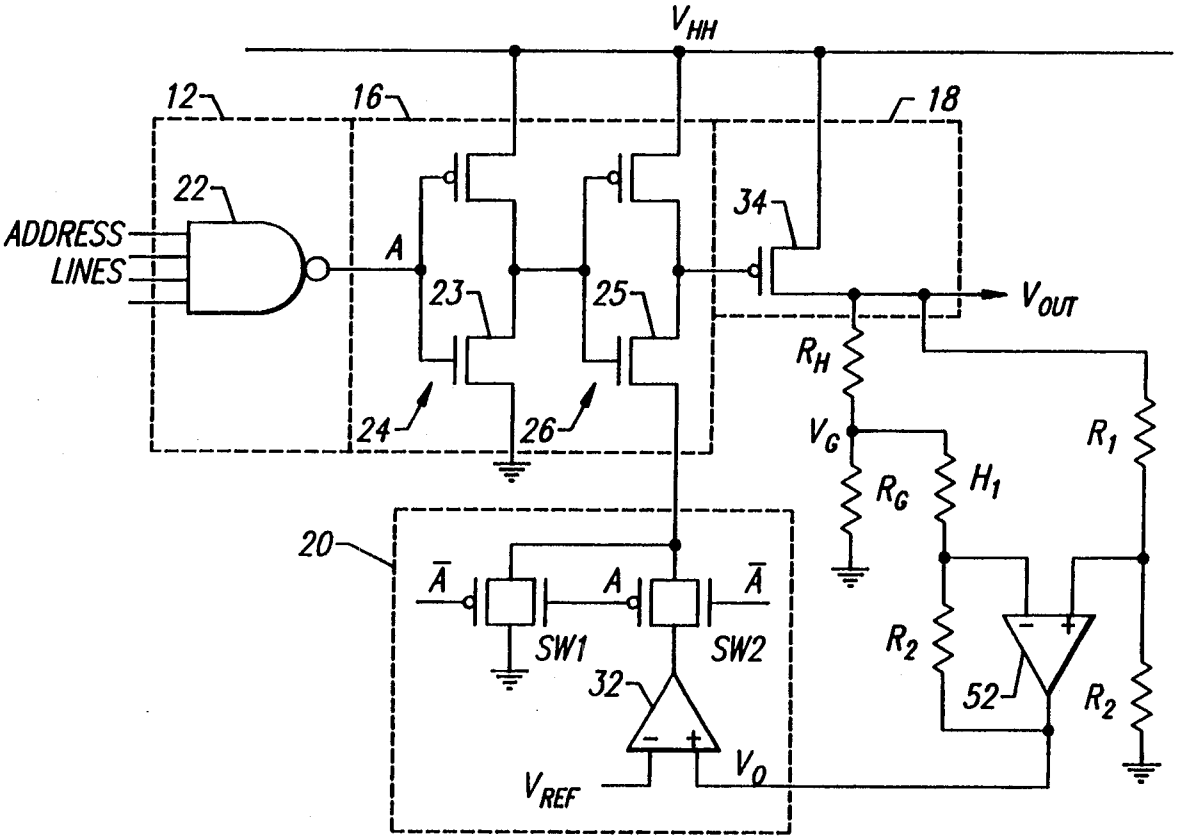
Fig. 2 is a schematic diagram of a second conventional energy control circuit for the heater resistor of a thermal inkjet printhead implemented in bipolar semiconductor technology.

FIG. 2 is a schematic diagram of a second conventional energy control circuit for the heater resistor of a thermal inkjet printhead implemented in bipolar semiconductor technology.

The operation of the circuits of FIGS. 1 and 2 are described in detail in the above-referenced U. S. Pat. No. 5,083,137 entitled ENERGY CONTROL CIRCUIT FOR A THERMAL INK-JET PRINTHEAD, issued Jan. 21, 1992 to Badyal et al., (the teachings of which have been incorporated herein by reference). In both circuits, an address decoder 12 allows for the selection of a particular heater resistor circuit by address signals provided in a manner well known in the art. The output of the decoder 12 is adjusted by a level shifting circuit 16 before being applied to a driver circuit 18 for the heater resistor RH. A measurement resistor R1 and a comparator circuit 20 are used to determine the voltage applied to the heater resistor RH and to provided a control signal to the level shifting circuit 16. In response to the control signal, the level shifting circuit 16 adjusts the signal applied to the driver circuit 18, which in turn applies the adjusted voltage to the heater resistor RH.

Note the amount of circuitry required to determine the voltage applied to the heater resistor. In FIG. 1, a separate resistor R1, a comparator 32, two switches and a level shifting circuit 16 are required to control the voltage applied to the heater resistor RH. In the bipolar case of FIG. 2, even more circuitry is required.

Figure 3:
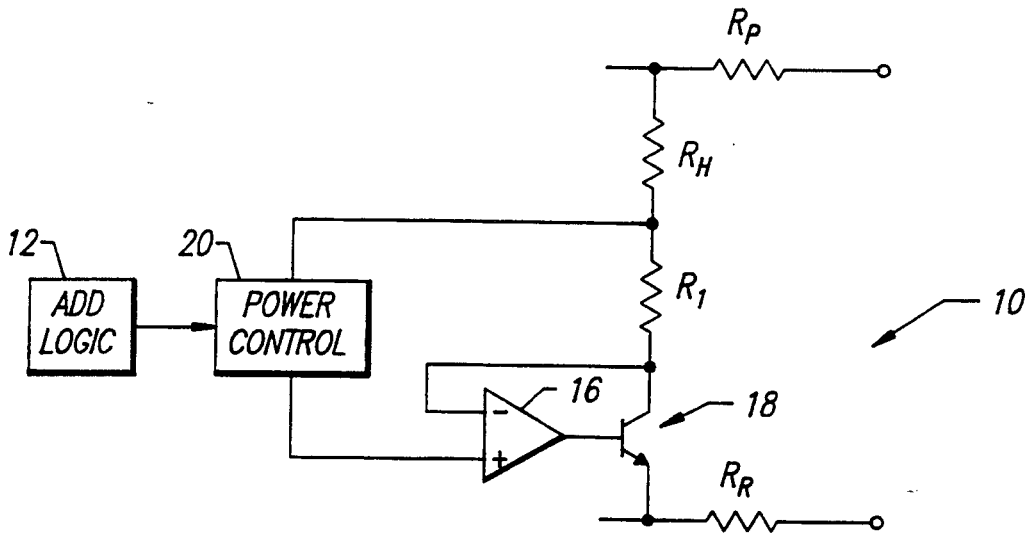
FIG. 3 PRIOR ART
FIG. 3 is a simplified schematic diagram of conventional circuits for controlling the energy applied to the heater resistor of thermal inkjet printheads.

FIG. 3 is a simplified schematic diagram of conventional circuits for controlling the energy applied to the heater resistor of thermal inkjet printheads. $R_P$ represents the parasitic resistance in the trace and $R_R$ represents the resistance in the return lead.

As mentioned above, the components required by conventional systems to control the voltage applied to the heater resistor of thermal inkjet printheads are costly to manufacture, consume space on the circuit board, consume power and lowers the reliability of the system. Accordingly, it is an object of the present invention to provide a simple, low cost, reliable system for controlling the power applied to the heater resistor of a thermal inkjet printhead which consumes little power.

Figure 4:
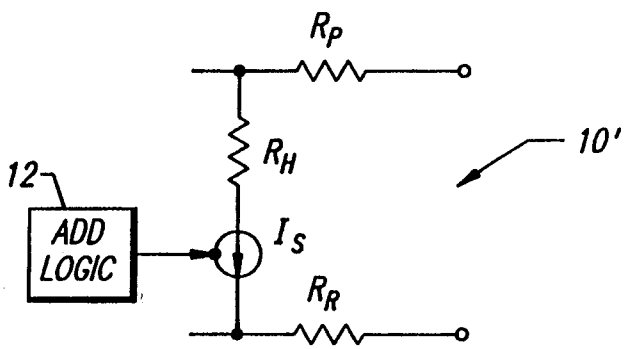
FIG. 4 is a simplified schematic diagram of an energy control circuit for the heater resistor of a thermal inkjet printhead constructed in accordance with the present teachings.

FIG. 4 is a simplified schematic diagram of an energy control circuit for the heater resistor of a thermal inkjet printhead constructed in accordance with the present teachings. Note that the sensing resistor R1, the power control circuitry 20 and the level shifting circuitry 16 are eliminated by the use of a current source $I_s$ in place of the driver 18.

Figure 5:
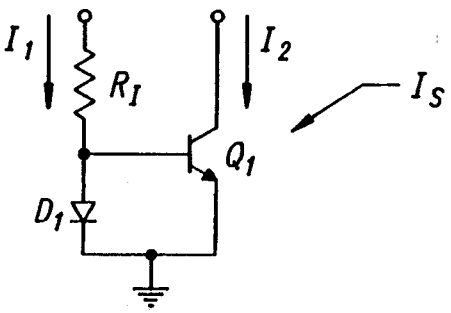
FIG. 5 is a schematic diagram of the current source $I_s$ of the energy control circuit for the heater resistor of a thermal inkjet printhead constructed in accordance with the present teachings.

FIG. 5 is a schematic diagram of the current source $I_s$. The current source includes a transistor Q1, the collector and emitter of which are connected in series with the heater resistor RH and the return path. In the illustrative embodiment, the transistor Q1 is a bipolar NPN transistor. Those skilled in the art will appreciate that the present teachings may be implemented with PNP or MOS technology without departing from the scope of the invention. The voltage applied to the base terminal of the transistor Q1 is controlled by a diode D1 connected between the base and emitter terminals of the transistor Q1. Since Q1 is an NPN transistor, the anode of the diode D1 is connected to the base terminal and the cathode is connected to the emitter of the transistor. A resistor $R_I$ is connected between the addressing logic 12 and the junction between the base of the transistor Q1 and the anode of the diode D1.

In an integrated circuit implementation, the diode may be created by connecting the collector and base terminals of a transistor. Ideally, the diode is fabricated on the same die as the transistor Q1 in close proximity thereto so that the characteristics of the diode will track those of the transistor Q1 with changes in temperature and manufacturing tolerances over time.

Those skilled in the art will appreciate that the matching of the active areas of the diode and the transistor are key considerations as the bandgap of silicon is a constant. If the geometries of the active areas of the diode D1 and the transistor Q1 in the integrated circuit mask are scaled, then the currents will be scaled. Therefore, if the transistor is k times the size of the diode, then the current through the transistor, $I_2$, is k times the current, $I_1$, through the diode where k is the ratio of the areas $A_{Q1}/A_{D1}$. Multiple transistors may be connected in parallel or multiple diodes may be connected in parallel for optimal matching or to achieve other relationships between the currents $I_1$ and $I_2$.

Additional control of the absolute delivered energy is may be required when precise control of the operational parameters of the printhead required by the printing system. These requirements may be beyond the accuracy of the manufacturing tolerances of the components that set the values of $I_1$ and $I_2$, the scale factor of the areas "k", and the value of the heater resistor. As these components affect the delivered energy according to the following equation, additional control is needed.

$$E=k(I_1)RHT(Pulse) \quad [1]$$

In the simplest implementation, the source for the programming current source $I_1$ can be set by the printing system and therefore control $I_2$ which sets the heater energy. If the printing system is not capable of controlling the programming current, then a system of setting the programming current can be implemented at the time of manufacture. One possible method is similar to the method currently used to program fuse link logic arrays.

Figure 6:
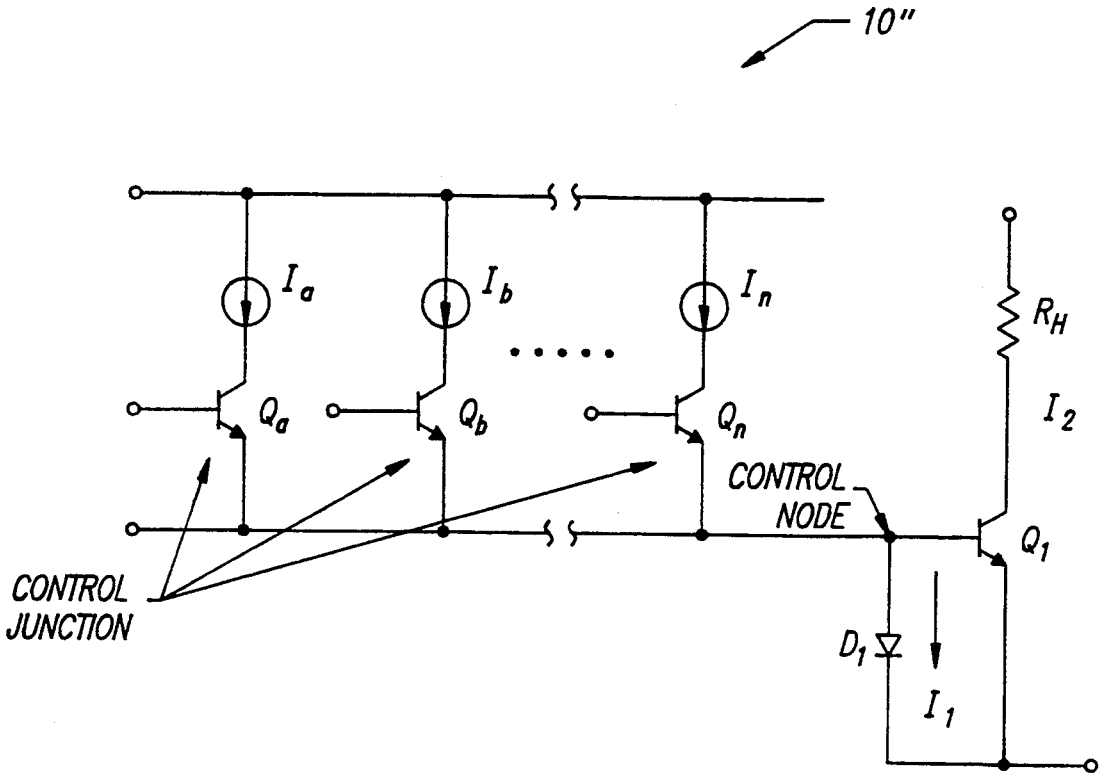
FIG. 6 is a schematic diagram of an alternative embodiment of an energy control circuit for the heater resistor of a thermal inkjet printhead constructed in accordance with the present teachings which shows how multiple current sources can be used to set the programming current $I_1$.

FIG. 6 is a schematic diagram of an alternative embodiment of an energy control circuit for the heater resistor of a thermal inkjet printhead constructed in accordance with the present teachings which shows how multiple current sources can be used to set the programming current $I_1$. By fusing the control junction of the transistors that feed the control node, any combination of currents $I_a$, $I_b$ to $I_n$ can be set. The unprogrammed current would be the sum of all of these currents or any combination thereof.

$$I_1=I_a+I_b+\ldots I_n \quad [2]$$

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. A circuit for controlling the power applied to the heater resistor of a thermal inkjet printer printhead, said heater resistor being connected to a first source of current, said circuit comprising:

a first transistor having a first terminal connected to said heater resistor and a second terminal connected to a return path for said heater resistor and means for maintaining a constant voltage at a third terminal of said transistor, said third terminal being the control terminal thereof and said means for maintaining a constant voltage including a diode connected between said second and third terminals of said first transistor to conduct when the junction between said second and third terminals of said transistor conducts.

2. The invention of claim 1 wherein said means for maintaining a constant voltage further includes a resistor connected between a second source of current and said third terminal of said transistor.

3. The invention of claim 1 wherein said transistor is a bipolar transistor.

4. The invention of claim 3 wherein said transistor is an NPN transistor.

5. The invention of claim 4 wherein the anode of said diode is connected to said third terminal of said transistor.

6. The invention of claim 5 wherein said diode is fabricated by connecting the base and collector terminals of a second transistor fabricated on a substrate with said first transistor.

7. A circuit for controlling the power applied to the heater resistor of a thermal inkjet printer printhead, said heater resistor being connected to a first source of current ($I_1$), said circuit comprising:

a first transistor having a first terminal connected to said heater resistor, a second terminal connected to a return path for said heater resistor and semiconductive material between said first and second terminals having a cross-sectional area $A_2$ and a diode connected between said second and third terminals of said first transistor, said third terminal being the control terminal thereof, to conduct when the junction between said second and third terminals of said transistor conducts to maintain a constant voltage at said control terminal of said transistor in response to a second current ($I_2$), said diode having semiconductive material with a cross-sectional area $A_1$, where $I_1=kI_2$ and where $k=A_2/A_1$.

8. The invention of claim 7 wherein said means for maintaining a constant voltage includes multiple diodes connected between said second and third terminals.

9. The invention of claim 8 wherein said diodes are fabricated by connecting the base and collector terminals of a transistor fabricated on a substrate with said first transistor.

10. The invention of claim 7 wherein said means for maintaining a constant voltage includes multiple resistors connected between a second source of current and said third terminal of said transistor.

11. The invention of claim 7 wherein said transistor is a bipolar transistor.

12. The invention of claim 11 wherein said transistor is an NPN transistor.

13. The invention of claim 12 wherein the anode of said diode is connected to said third terminal of said transistor.

* * * * *